US012029321B2

(12) United States Patent
Shih et al.

(10) Patent No.: US 12,029,321 B2
(45) Date of Patent: Jul. 9, 2024

(54) DISMANTLABLE ELECTRIC BED

(71) Applicant: Chuan-Hang Shih, Changhua County (TW)

(72) Inventors: Chuan-Hang Shih, Changhua County (TW); Yu-Chi Yang, Changhua County (TW)

(73) Assignee: Chuan-Hang Shih, Lukang Township, Changhua County (TW)

( * ) Notice: Subject to any disclaimer, the term of this patent is extended or adjusted under 35 U.S.C. 154(b) by 0 days.

(21) Appl. No.: 17/166,699

(22) Filed: Feb. 3, 2021

(65) Prior Publication Data

US 2022/0160140 A1 May 26, 2022

(30) Foreign Application Priority Data

Nov. 26, 2020 (TW) ..... 109141557

(51) Int. Cl.
*A47C 20/04* (2006.01)
*A47C 19/00* (2006.01)
*A47C 19/02* (2006.01)

(52) U.S. Cl.
CPC ..... *A47C 20/041* (2013.01); *A47C 19/005* (2013.01); *A47C 19/025* (2013.01)

(58) Field of Classification Search
CPC ... A47C 20/041; A47C 19/005; A47C 19/025; A47C 21/04; Y10T 24/44974; F16B 12/30
See application file for complete search history.

(56) References Cited

U.S. PATENT DOCUMENTS

| | | | | |
|---|---|---|---|---|
| 2,756,442 | A * | 7/1956 | De Boer | A47C 19/005 5/287 |
| 11,103,076 | B2 * | 8/2021 | Oh | A47C 19/024 |
| 11,466,717 | B2 * | 10/2022 | Bruno | F16B 5/0012 |
| 2011/0155284 | A1 * | 6/2011 | Hicks | A47C 19/005 144/344 |
| 2016/0206113 | A1 * | 7/2016 | Rawls-Meehan | A47C 21/003 |
| 2017/0055715 | A1 * | 3/2017 | Rohr | A47C 19/021 |
| 2018/0125252 | A1 * | 5/2018 | Chung | A47C 20/04 |
| 2019/0323534 | A1 * | 10/2019 | Derelöv | F16B 12/26 |
| 2020/0214463 | A1 * | 7/2020 | Xie | A47C 20/041 |
| 2020/0355210 | A1 * | 11/2020 | Koo | F16B 12/42 |
| 2020/0375368 | A1 * | 12/2020 | Choi | A47C 20/04 |
| 2021/0018028 | A1 * | 1/2021 | Hutson | F16B 12/48 |

* cited by examiner

*Primary Examiner* — David R Hare
*Assistant Examiner* — Alison N Labarge
(74) *Attorney, Agent, or Firm* — MUNCY, GEISSLER, OLDS & LOWE, PC

(57) ABSTRACT

A dismantlable electric bed includes a fixation frame, a moveable frame, and an actuator. The moveable frame includes two longitudinal rods and a transverse rod having two ends. The two longitudinal rods are pivotally connected with the fixation frame, respectively. Each longitudinal rod has at least one insertion hole. Each end of the transverse rod is provided with at least one post detachably inserted into the at least one insertion hole of one longitudinal rod. The actuator has two ends pivotally connected with the fixation frame and the transverse rod, respectively. As such, the electric bed is dismantlable to reduce the packing volume thereof and convenient to be assembled by the user herself/himself.

3 Claims, 8 Drawing Sheets

DISMANTLABLE ELECTRIC BED

BACKGROUND OF THE INVENTION

1. Field of the Invention

The present invention relates generally to an electric bed and more particularly, to a dismantlable electric bed that can be easily dismantled and assembled.

2. Description of the Related Art

Conventional electric bed is generally composed of a fixation frame, a moveable frame, and an actuator connected between the fixation frame and the moveable frame. The moveable frame is driven by the actuator to move relative to the fixation frame to lift the user's back and legs. To achieve structural stability, the fixation frame and the moveable frame of the conventional electric bed are assembled by welding, which cannot be dismantled according to the user's discretion. As a result, the conventional electric bed has usually a bulky packing volume, resulting in difficulty in transportation thereof to the dealer and/or buyer.

SUMMARY OF THE INVENTION

The present invention has been accomplished in view of the above-noted circumstances. It is an objective of the present invention to provide a dismantlable electric bed, which can be easily dismantled to reduce packing volume thereof, thereby achieving convenience of transportation thereof. Further, the electric bed can be assembled easily, such that the electric bed can be conveniently assembled by the user himself/herself.

To attain the above objectives, the present invention provides a dismantlable electric bed comprising a fixation frame, a moveable frame, and an actuator. The moveable frame includes two longitudinal rods and a transverse rod having two ends. The two longitudinal rods are pivotally connected with the fixation frame, respectively. Each longitudinal rod has at least one insertion hole. Each end of the transverse rod is provided with at least one post detachably inserted into the at least one insertion hole of one longitudinal rod. The actuator has two ends pivotally connected with the fixation frame and the transverse rod, respectively.

Because the fixation frame, the moveable frame and the actuator of the electric bed are dismantlable, particularly the moveable frame can be dismantled to greatly reduce the packing volume of the electric bed, thereby achieving convenience in transportation thereof. Further, the electric bed can be easily assembled, such that it is convenient to be assembled by the user herself/himself.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
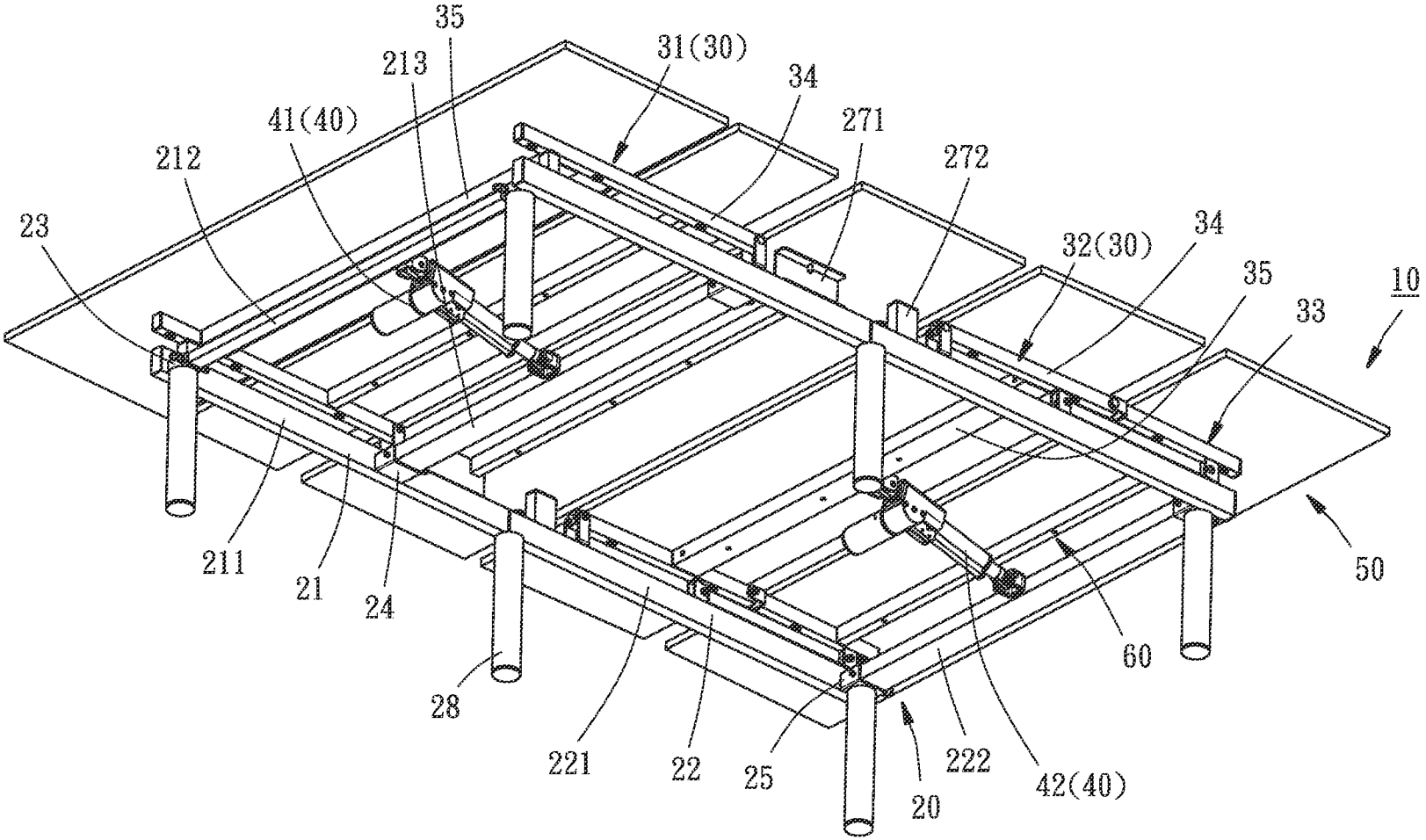
FIG. 1 is a perspective view of a dismantlable electric bed according to a first embodiment of the present invention.
Figure 2:
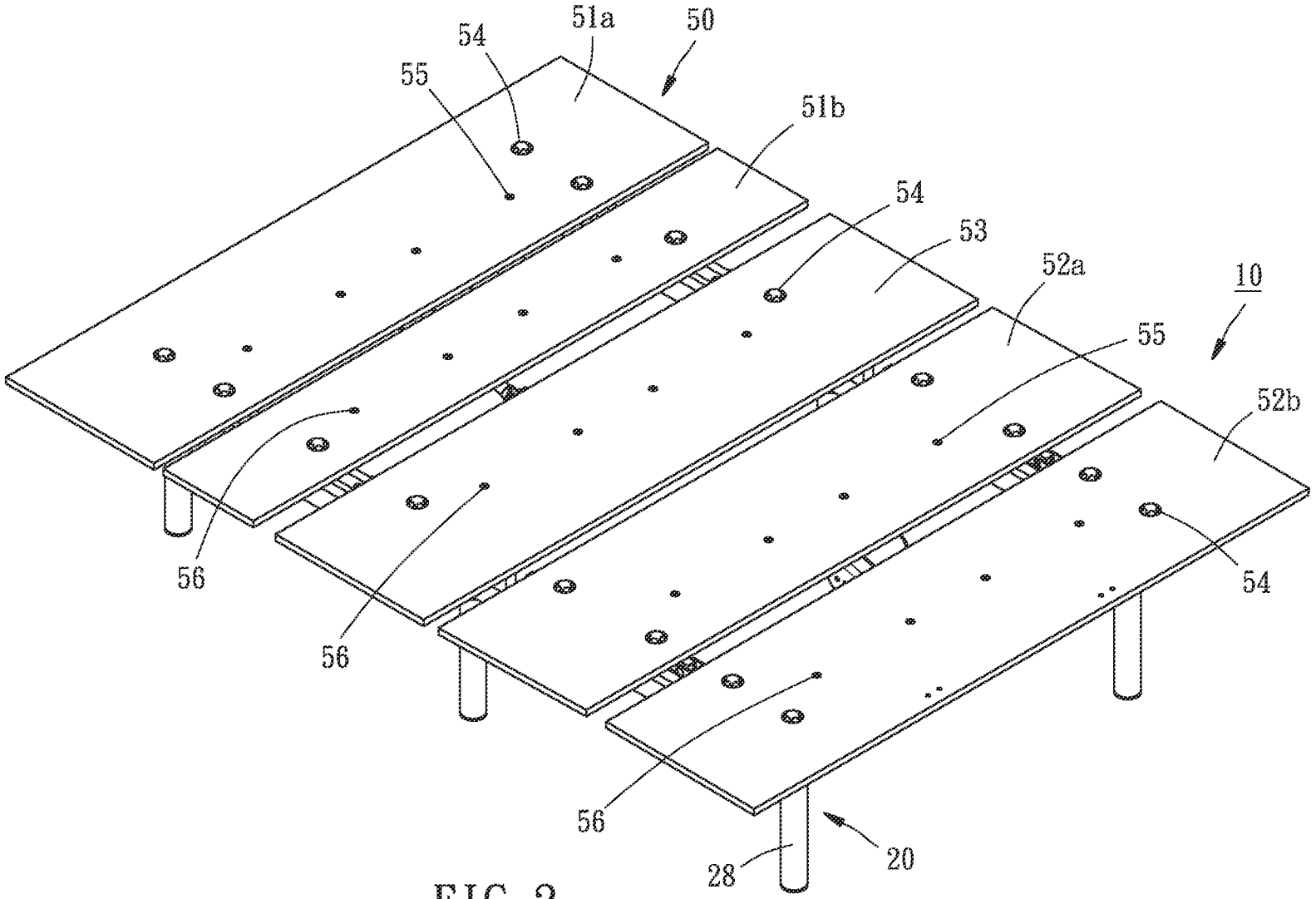
FIG. 2 is another perspective view of the dismantlable electric bed of the first embodiment of the present invention.

The structure and technical features of the present invention will be detailedly described hereunder by two embodiments and accompany drawings. As shown in FIGS. 1-2, a dismantlable electric bed 10 provided in accordance with a first embodiment of the present invention is composed of a fixation frame 20, two moveable frames 30, a lower leg supporting frame 33, two actuators 40, and a plurality of bed plates 50. It is to be especially mentioned that the directions or the like used in this description are based on the reference directions of FIG. 1. For example, the "front side" of the electric bed 10 is directed to the left side of FIG. 1, and the "rear side" of the electric bed 10 is directed to the right side of FIG. 1. Similarly, the "top side" and "bottom side" of the electric bed 10 are directed to the upper and lower sides of FIG. 1. These directions or the like are used to illustrate and understand the embodiments of the present invention, not to limit the claim scope of the present invention.

Figure 3:
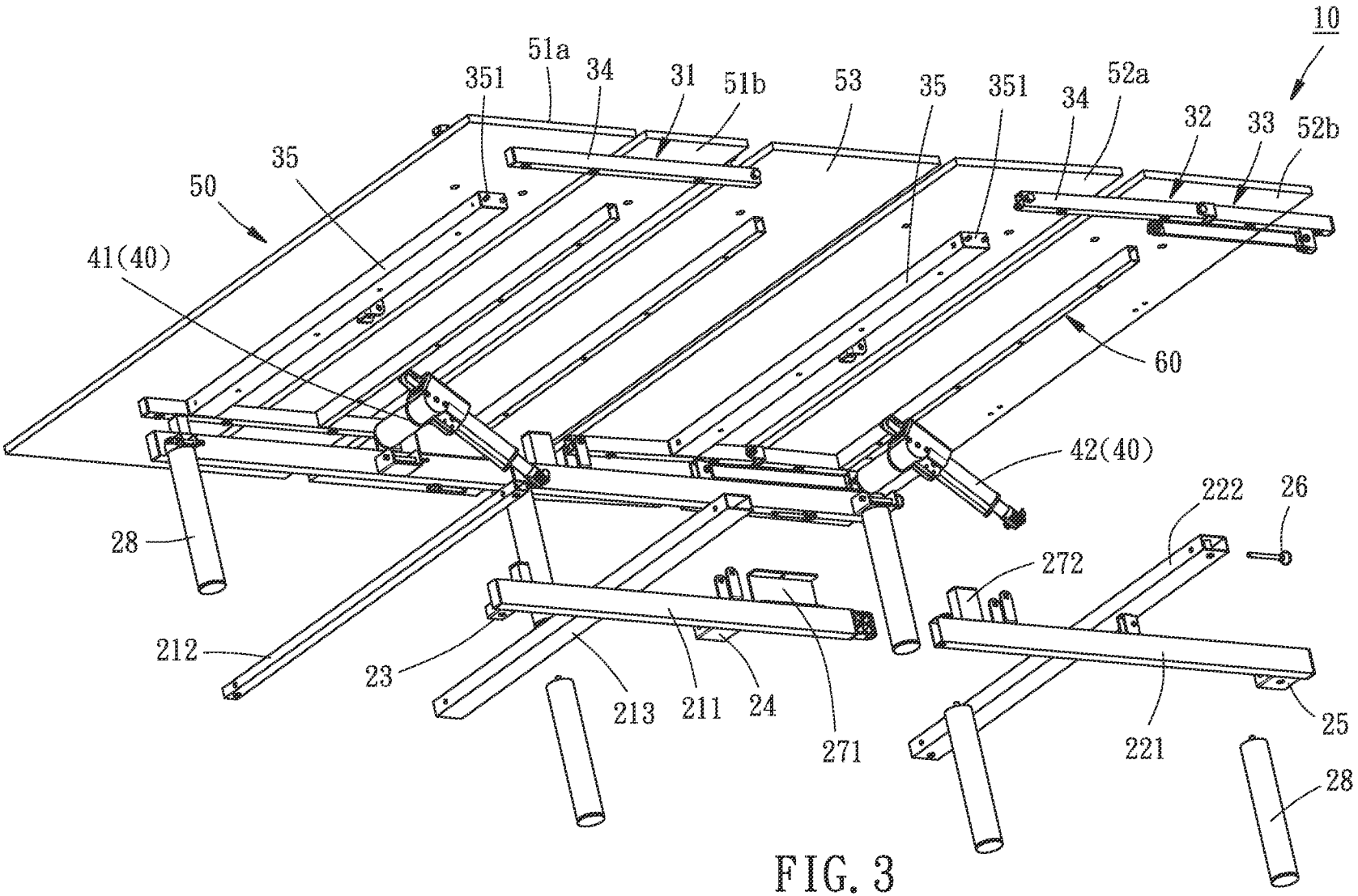
FIG. 3 is an exploded view of the dismantlable electric bed of the first embodiment of the present invention.

The fixation frame 20 has a rectangular shape, including a front rack 21 and a rear rack 22, which are dismantlably assembled with each other. The front rack 21 includes two front rods 211 longitudinally arranged and parallel to each other, and a link rod 212 and a first support rod 213 transversally arranged and parallel to each other. The link rod 212 is disposed between the front ends of the two front rods 211, and the first support rod 213 is disposed between the middle parts of the two front rods 211. As shown in FIGS. 1 and 3, the inner side of each of the two front rods 211 is provided with a first abutment portion 23 having an opening facing upwardly, and a second abutment portion 24 having an opening facing upwardly. The two first abutment portions 23 respectively support the two ends of the link rod 212 thereon, and the end of the link rod 212 and the first abutment portion 23 are locked with each other by a pin 26 penetrating therebetween. The two second abutment portions 24 respectively support two ends of the first support rod 213 thereon, and the end of the first support rod 213 and the second abutment portion 24 are locked with each other by another pin 26 penetrating therebetween. The rear rack 22 is similar in structure to the front rack 21. The rear rack 22 includes two rear rods 221 longitudinally and respectively connected with the two front rods 211, and a second support rod 222 transversally disposed between rear ends of the rear rods 221. The inner side of each of the two rear rods 221 is provided with a third abutment portion 25 having an opening facing upwardly, as shown in FIG. 1. The two third abutment portions 25 respectively support two ends of the second support rod 222 thereon, and the end of the second support rod 222 and the third abutment portion 25 are locked with each other by a pin 26 penetrating therebetween.

Referring to FIGS. 1 and 3 again, on the top side of the fixation frame 20, two front abutment portions 271 disposed on the two front rods 211 of the front rack 21 and two rear abutment portions 272 disposed on the two rear rods 221 of the rear rack 22 are provided. Further, six legs 28 are provided at the bottom side of the fixation frame 20 and coupled with the front rack 21 and the rear rack 22 by screw fastening way. However, in another embodiment, the legs 28 can be omitted.

Figure 4:
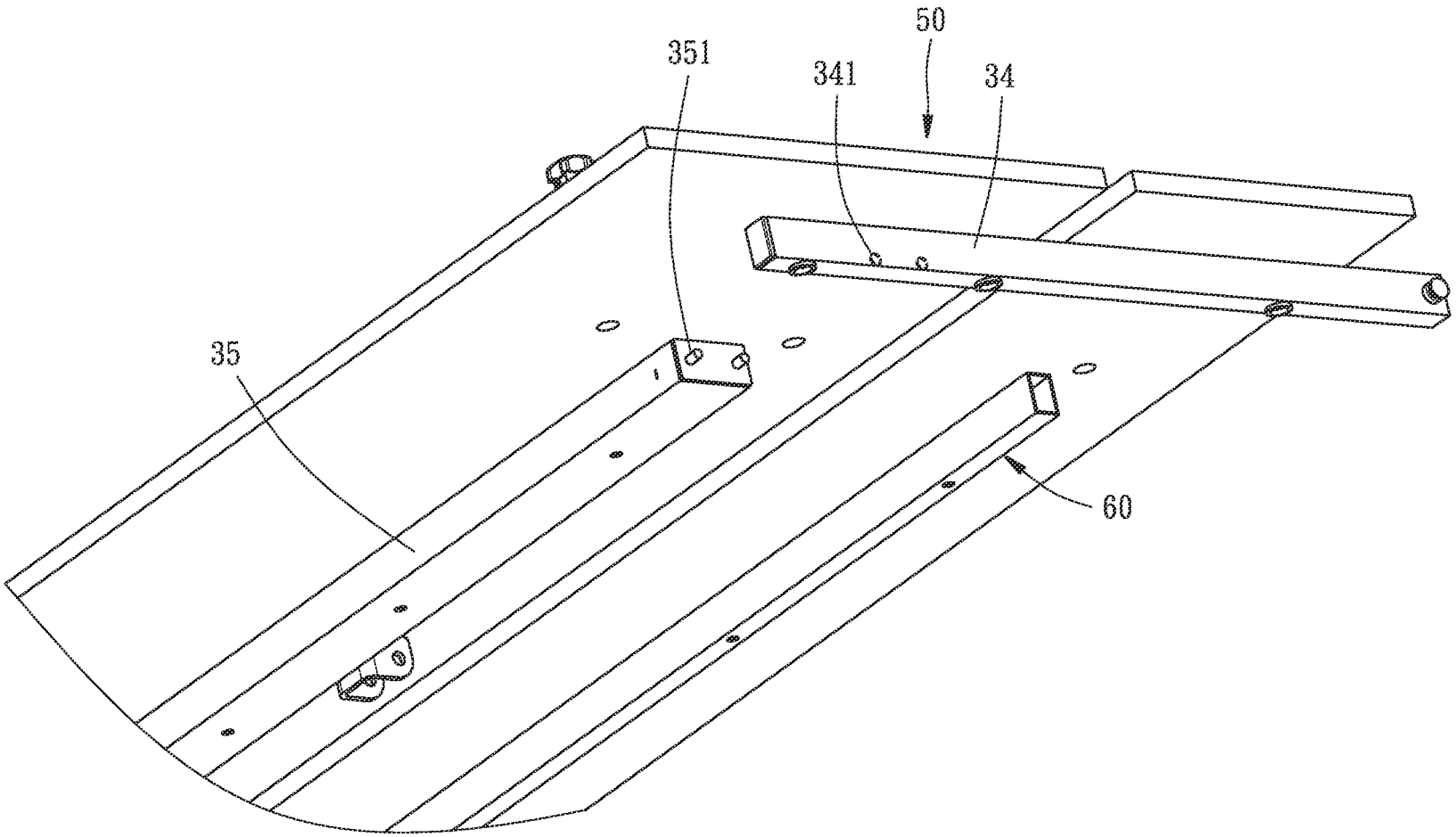
FIG. 4 is an enlarged view of a part of the dismantlable electric bed of the first embodiment of the present invention.

As shown in FIGS. 1 and 2, the two moveable frames 30 are pivotally connected at the top side of the fixation frame 20. The two moveable frames 30 comprise a back supporting frame 31 pivotally connected with the front rack 21, and a thigh supporting frame 32 pivotally connected with the rear rack 22. The lower leg supporting frame 33 is pivotally connected with the thigh supporting frame 32. Since the back supporting frame 31 and the thigh supporting frame 32 have a similar structure therebetween, which mainly comprise two longitudinal rods 34 and a transverse rod 35, hereunder the back supporting frame 31 will be taken as an example to be detailedly illustrated for concise illustration purpose. As show in FIGS. 1 and 3, the two longitudinal rods 34 of the back supporting frame 31 are pivotally and respectively connected at their rear ends with the two front rods 211 of the front rack 21, and the transverse rod 35 is dismantlably coupled with the two longitudinal rods 34. Referring to FIG. 4, each end of the transverse rod 35 is provided with two extending posts 351 each having a smooth non-wavy outer periphery along the length direction of the transverse rod 35, and the inner side of each longitudinal rod 34 is provided with two insertion holes 341 into which the two posts 351 are inserted, such that the transverse rod 35 and the two longitudinal rods 34 are detachably combined together. In another embodiment, each end of the transverse rod 35 is provided with one or more posts 351, and the inner side of each longitudinal rod 34 is provided with one or more insertion holes 341 as long as the transverse rod 35 and the two longitudinal rods 34 can be detachably combined together.

Figure 5:
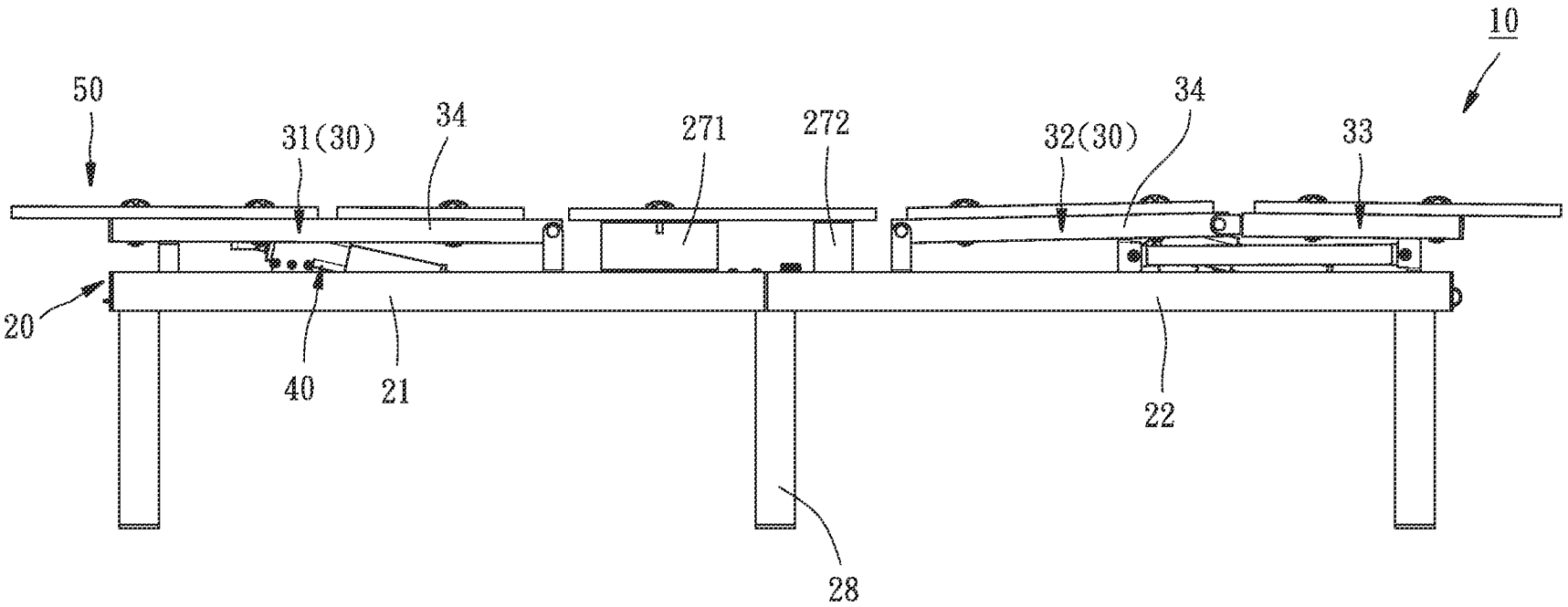
FIG. 5 is a lateral side view of the dismantlable electric bed of the first embodiment of the present invention, showing moveable frames of the electric bed are stayed at a horizontal position.
Figure 6:
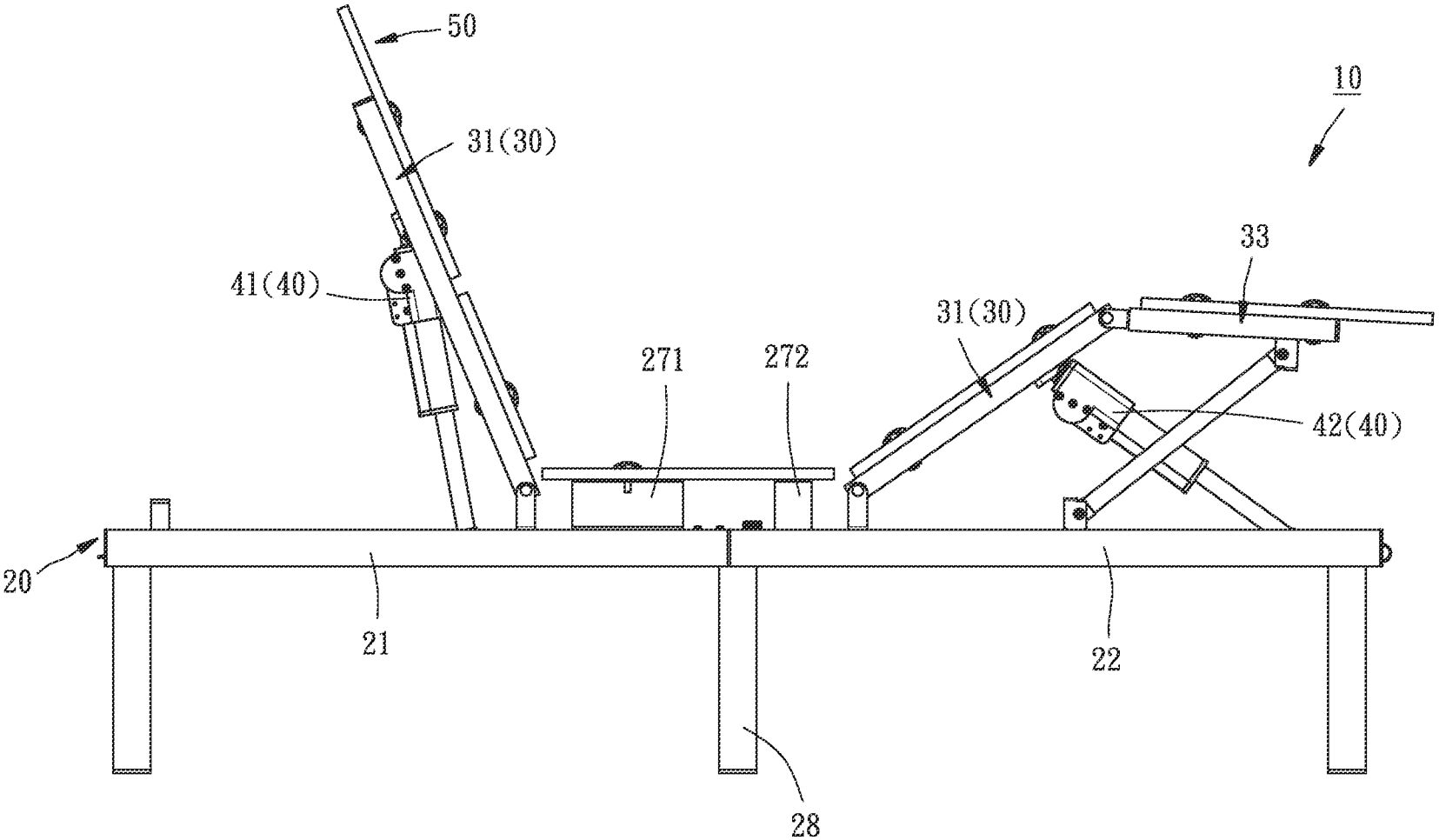
FIG. 6 is another lateral side view of the dismantlable electric bed of the first embodiment of the present invention, showing the moveable frames are inclined and lifted.

Referring to FIGS. 1 and 3, each of the two actuators 40 has two ends pivotally connected with the fixation frame 20 and the transverse rod 35 of one of the moveable frames 30, such that the each moveable frame 30 can be driven by one of the actuators 40 to swing between a horizontal position, as show in FIG. 5, and an inclined position, as show in FIG. 6. Because the transverse rod 35 and the two longitudinal rods 34 are combined together by the abovementioned structure, they will have a stable structure enabling to sustain a relatively greater load thereon. Specifically speaking, the two actuators 40 comprise a front actuator 41 and a rear actuator 42. The front actuator 41 is pivotally connected between the front rack 21 and the back supporting frame 31 in a way that the two ends of the front actuator 41 are pivotally connected with the first support rod 213 and the transverse rod 35 of the back supporting frame 31, respectively. The rear actuator 42 is pivotally connected between the rear rack 22 and the thigh supporting frame 32 in a way that the two ends of the rear actuator 42 are pivotally connected with the second support rod 222 and the transverse rod 35 of the thigh supporting frame 32, respectively. When the rear actuator 42 drives the thigh supporting frame 32 to upwardly swing relative to the rear rack 22, as shown in FIG. 6, the thigh frame 32 will synchronously lift the lower leg frame 33 upwardly.

Referring to FIGS. 1 and 2, the bed plates 50 are adapted for supporting a mattress (not shown) thereon. The bed plates 50 comprise two upper body supporting plates 51*a* and 51*b* fixed to the back supporting frame 31 by bolts, two lower body supporting plates 52*a* and 52*b* respectively fixed to the thigh supporting frame 32 and the lower leg supporting frame 33 by bolts, and a buttocks supporting plate 53 fixed to the two front abutment portions 271 and the two rear abutment portions 272. In this embodiment, the upper body supporting plates 51*a* and 51*b* are fixed to the two longitudinal rods 34 by a plurality of first bolts 54, and the upper body supporting plate 51*a* in front of the upper body supporting plate 51*b* is further fixed to the transverse rod 35 of the back supporting frame 31 by a plurality of second bolts 55. Similarly, the lower body supporting plates 52*a* and 52*b* are fixed to the thigh supporting frame 32 and the lower leg supporting frame 33 by a plurality of first bolts 54, and the lower body supporting plate 52*a* in front of the lower body supporting plate 52*b* is further fixed to the transverse rod 35 of the thigh supporting frame 32 by a plurality of second bolts 55. The buttocks supporting plate 53 is fixed to the two front abutment portions 271 by a plurality of first bolts 54.

In another aspect, the electric bed 10 further comprises three reinforcing rods 60, which are fixed to the bottom sides of the upper body supporting plate 51*b*, the lower body supporting plate 52*b* and the buttocks supporting plate 53 by a plurality of third bolts 56, as shown in FIGS. 1-3, thereby reinforcing the structural strengths of the plates 51*b*. 52*b* and 53.

Because the fixation frame 20, the two moveable frames 30 and the two actuators 40 are all dismantlable, the packing volume of the electric bed 10 can be greatly reduced, thereby achieving convenience in transportation to user. Further, the electric bed 10 can be easily assembled. For example, to assemble the moveable frame 30, the user only needs to insert the posts 351 of the transverse rod 35 into the insertion holes 341 of the two longitudinal rods 34. In other words, the electric bed 10 of the present invention can be conveniently assembled by the user himself/herself, and the assembled electric bed 10 has a stable structure that can sustain the acting forces of the actuators 40, such that the electric bed 10 of the present invention has a great marketing potential.

Figure 7:
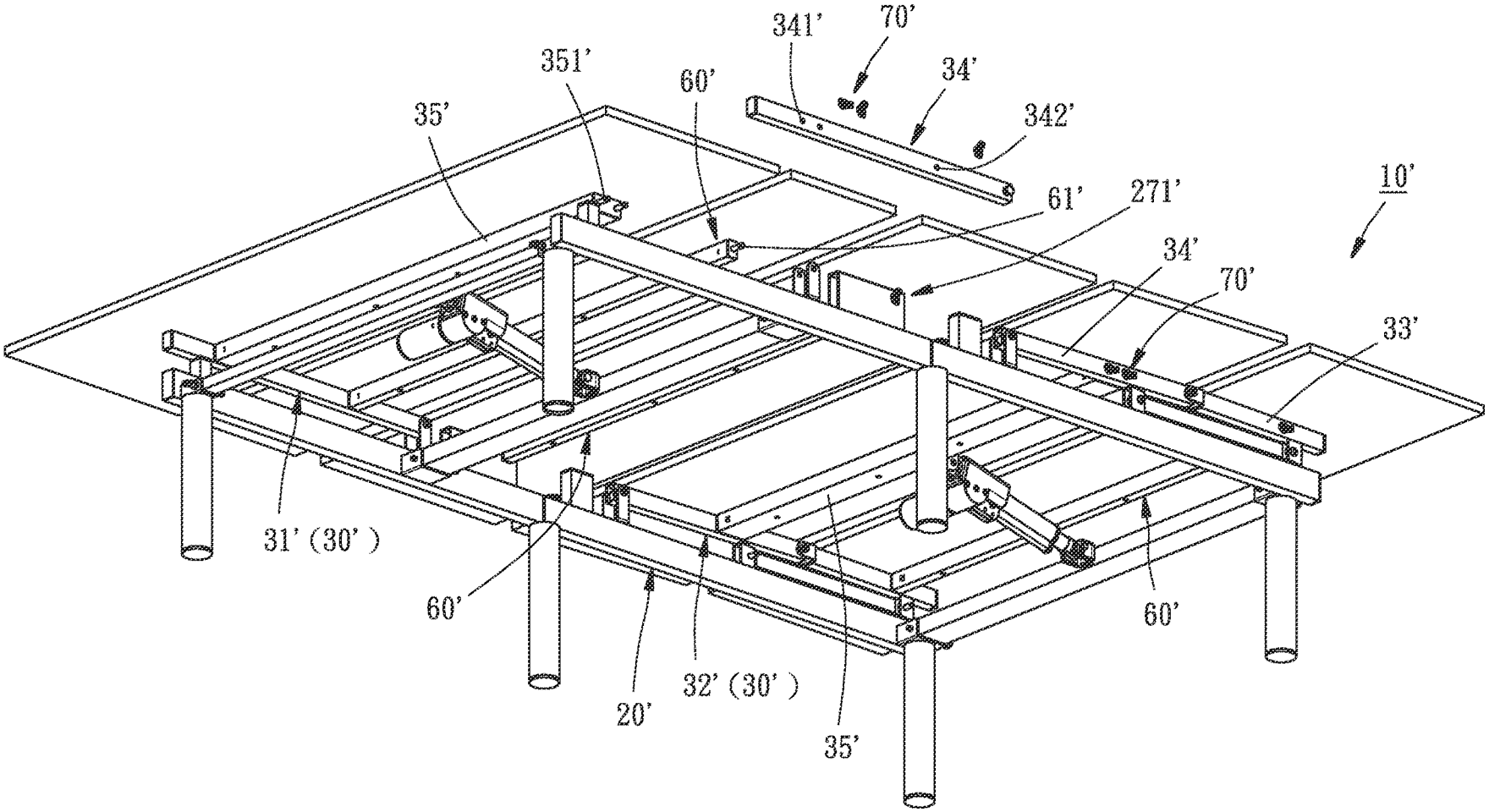
FIG. 7 is an exploded view of a dismantlable electric bed according to a second embodiment of the present invention.
Figure 8:
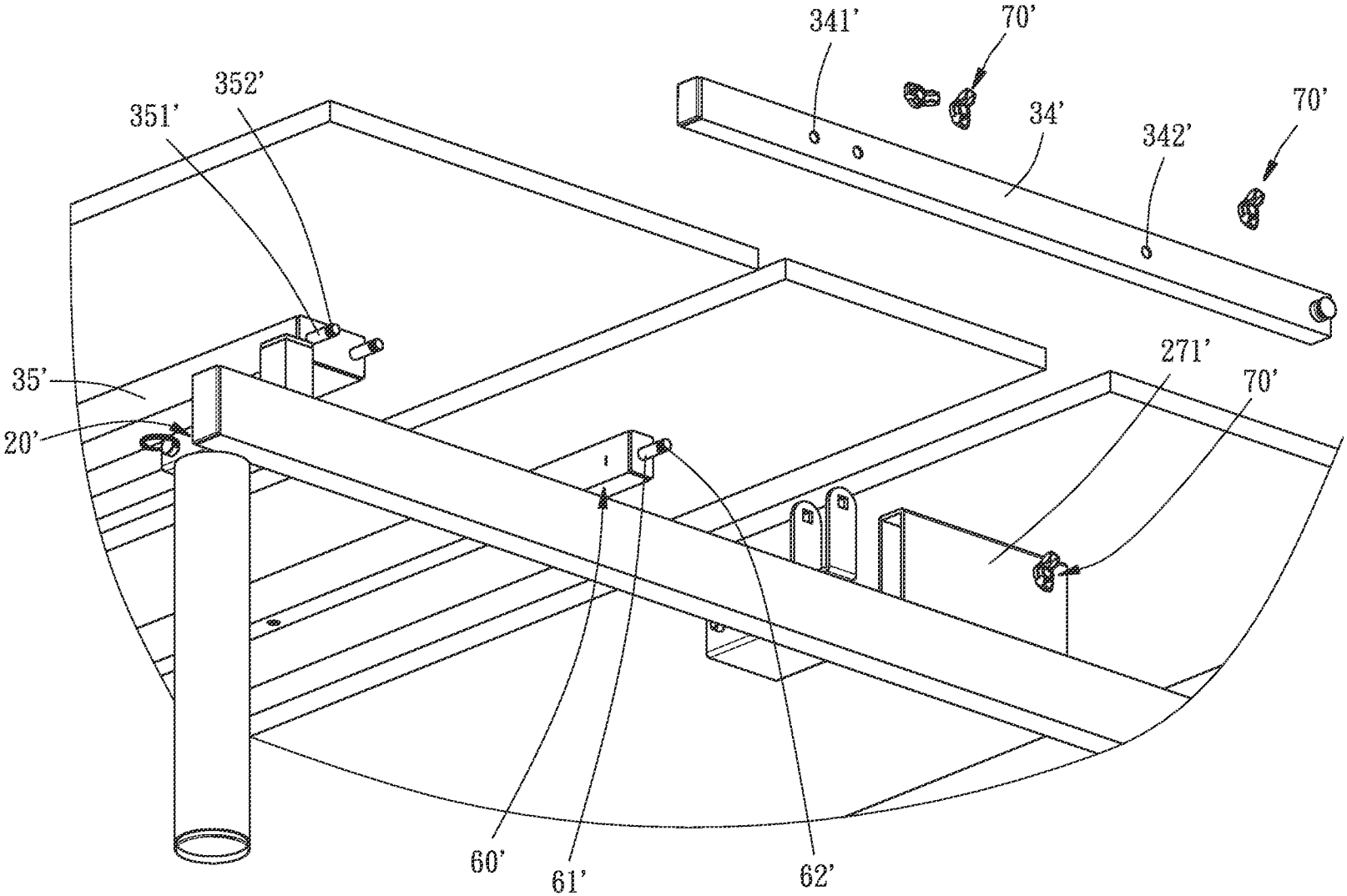
FIG. 8 is an enlarged view of a part of the dismantlable electric bed of the second embodiment of the present invention.

Referring to FIGS. 7 and 8, a dismantlable electric bed 10' in accordance with a second embodiment of the present invention is disclosed. The electric bed 10' is basically similar in structure with the electric bed 10 of the first embodiment of the present invention with the difference lying in that the insertion holes 341' of the two longitudinal rods 34' of the moveable frame 30' are through holes penetrating through the inner and outer sides of the longitudinal rods 34', and the posts 351' of the transverse rod 35' are inserted through and protruded over the insertion holes 341' of the two longitudinal rods 34'. As shown in FIG. 8, the post 351' of the transverse rod 35' is provided with an external thread 352'. After the posts 351' are inserted through the insertion holes 341', a nut 70' is screwingly threaded onto the external thread 352' of each post 351', such that the longitudinal rods 34' and the transverse rod 35' can be firmly assembled together. In this embodiment, the nuts 70' are realized as butterfly nuts that can be loosened and tightened by hand without any tool. However, the nuts 70' are not limited to butterfly nuts for the present invention.

Another difference between the electric bed 10' of this embodiment and the electric bed 10 of the first embodiment lies in that the reinforcing rods 60' are respectively combined with the back supporting frame 31', the lower leg supporting frame 33' and the two front abutment portions 271' by nut-and-thread fastening way. Because the fastening ways of the reinforcing rods 60' are the same, hereunder only the fastening way between the reinforcing rod 60' and the back supporting frame 31' will be detailedly illustrated as an example for concise illustration purpose. Referring to FIG. 8, each of the two ends of the reinforcing rod 60' is provided with a connecting post 61' having an external thread 62'. The two longitudinal rods 34' have a plurality of through holes 342' through which the connecting posts 61' extend respectively. By means of fastening the nuts 70' onto the external threads 62' of the reinforcing rod 60' respectively, the reinforcing rod 60' and the two longitudinal rods 34' can be firmly combined together, thereby stabilizing the structures of the moveable frames 30' and the fixation frame 20'.

Based on the technical features of the present invention, various modifications to the dismantlable electric beds 10 and 10' may be made. For example, the structures of the fixation frame 20 and 20' may be reconstructed in accordance with actual requirement, the bed plats 50 may be omitted, and one or more reinforcing rods 60 may be provided in accordance with actual requirement or may be omitted. Such variations are not to be regarded as a departure from the spirit and scope of the invention, and all such modifications as would be obvious to one skilled in the art are intended to be included within the scope of the following claims.

What is claimed is:

1. A dismantlable electric bed, comprising:

a fixation frame;

a moveable frame including two longitudinal rods and a transverse rod having two ends; wherein the two longitudinal rods are pivotally connected with the fixation frame respectively, each of the longitudinal rods has two insertion holes, and each of the two ends of the transverse rod is provided with two extending posts that extend along a length direction of the transverse rod and are detachably inserted into the two insertion holes of one of the longitudinal rods, respectively;

a bed plate disposed on a top side of the moveable frame and assembled with the transverse rod;

an actuator having two ends directly and pivotally connected to the fixation frame and the transverse rod, respectively; and a reinforcing rod disposed at a bottom side of the bed plate, wherein the two extending posts each have a smooth, non-wavy outer periphery along the length direction of the transverse rod, wherein the fixation frame comprises two rods longitudinally arranged and parallel to each other, wherein each of the two rods is located right below one of the longitudinal rods, and wherein each of the longitudinal rods has an end pivotally connected with one of the two rods of the fixation frame through an upright member.

2. The dismantlable electric bed as claimed in claim 1, wherein the bed plate is assembled with the two longitudinal rods by a plurality of first bolts.

3. The dismantlable electric bed as claimed in claim 1, wherein the bed plate is assembled with the transverse rod by a plurality of second bolts.

* * * * *